United States Patent [19]

Kim

[11] Patent Number: 4,998,720

[45] Date of Patent: Mar. 12, 1991

[54] EXERCISE DEVICE

[76] Inventor: Insop Kim, 4-21 Schorr Dr., College Point, N.Y. 11356

[21] Appl. No.: 487,129

[22] Filed: Mar. 2, 1990

[51] Int. Cl.[5] ..... A63B 23/04

[52] U.S. Cl. ..... 272/96; 272/137; 272/142; 128/25 R

[58] Field of Search ..... 272/96, 97, 135-143, 272/146, DIG. 4; 128/25 B

[56] References Cited

U.S. PATENT DOCUMENTS

| | | | |
|---|---|---|---|
| 1,911,390 | 5/1933 | Pullman | 272/96 |
| 2,760,774 | 8/1956 | Perez | 272/96 |
| 2,820,454 | 1/1958 | Wright | 272/96 X |
| 3,372,930 | 3/1968 | Sertich | 272/96 X |
| 3,421,760 | 1/1969 | Freeman, Jr. | 272/96 |
| 3,487,829 | 1/1970 | Barnett | 272/96 X |
| 4,199,137 | 4/1980 | Gigue're | 272/96 |
| 4,306,714 | 12/1981 | Loomis et al. | 272/96 |
| 4,452,447 | 6/1984 | Leplet et al. | 272/96 |
| 4,650,183 | 3/1987 | McInttre | 128/25 B X |
| 4,733,859 | 3/1988 | Kock et al. | 272/96 |

FOREIGN PATENT DOCUMENTS

| | | | |
|---|---|---|---|
| 535559 | 10/1931 | Fed. Rep. of Germany | 272/143 |
| 103541 | 1/1964 | Norway | 272/96 |
| 1289516 | 2/1987 | U.S.S.R. | 272/96 |

*Primary Examiner*—Robert Bahr

*Attorney, Agent, or Firm*—Richard C. Litman

[57] ABSTRACT

An exercise device for strengthening the muscles of the upper leg and the buttocks region. Two foot platforms are pivoted off center in relation to the user's foot. The heels of each foot can be brought together under tension by an elastic cord between the toe regions of the foot platforms. Included with the exercise device is a tension adjusting mechanism that allows the use to change the tension involved in bringing the heels together. Also included with the exercise device is a heel riser that raises up the heels of the feet when the heels are brought together.

8 Claims, 2 Drawing Sheets

FIG. 1
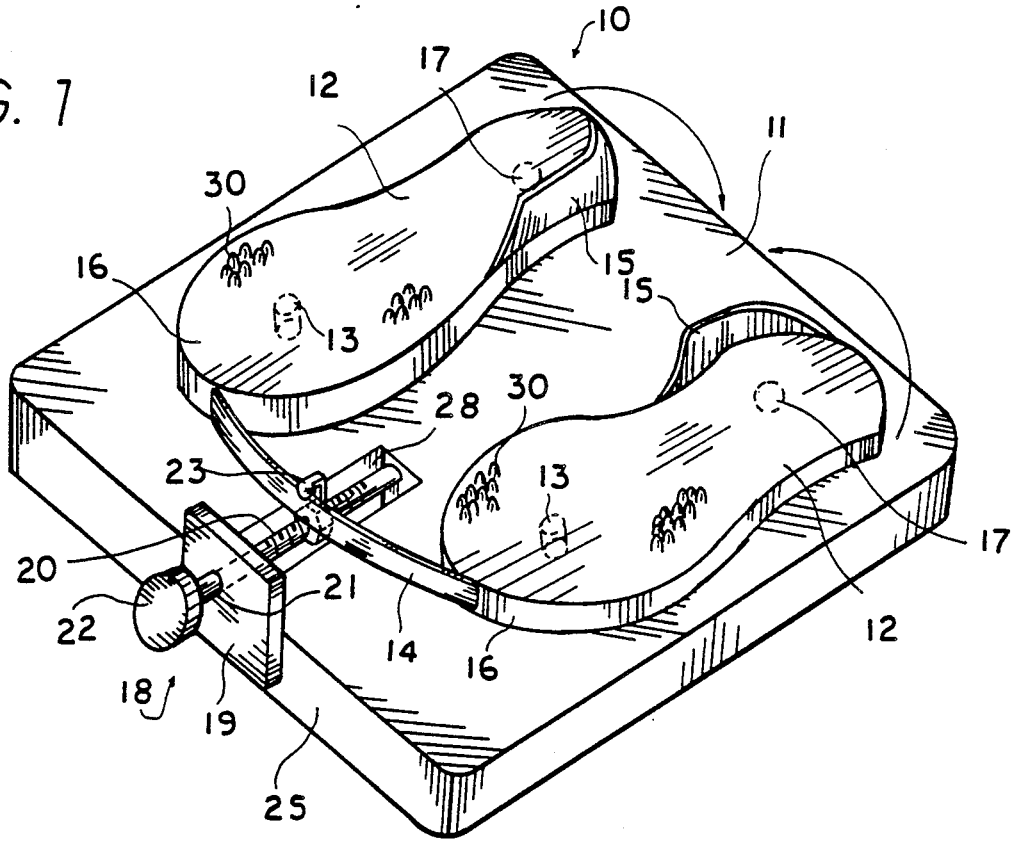
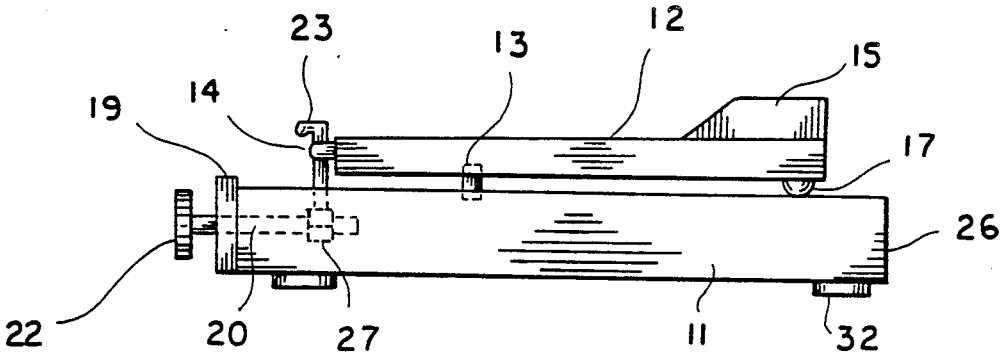
FIG. 2

EXERCISE DEVICE

BACKGROUND OF THE INVENTION

1. Field of the Invention

The present invention relates to an exercise device that involves exercising the feet. More particualry, it involves repetitively rotating the heels in unison against tension to produce a strengthened condition of the upper leg and buttocks including the gluteg, gracilis and adductor muscles.

2. Description of the Prior Art

Numerous prior art devices are known that are used to strengthen the muscles of the foot region and of the leg. U.S. Pat. No. 3,529,818 issued to Aijala discloses an exercise device that utilizes two spring linked rotatable platforms upon which the feet are placed. The axis of rotation of this device is generally toward the center of the foot. It is necessary for this deviceto place the axis of rotation at the center in order to simulate the movements used in skiing. This kind of movement is not desired by the applicant and therefore the present device has a completely different action.

U.S. Pat. No. 3,650,528 issued to Natterer describes another ski training device that has an action similar to that of the above Aijala device. Again the center of rotation is in the center of the ski and foot area. U.S. Pat. No. 3,702,188 issued to Phillips et al. describes another rotational platform that makes use of hydraulics to provide resistance to the rotation. Still, this machine utilizes a central rotation point for the foot which is unlike the applicant's invention. Finally U.S. Pat. No. 4,768,778 issued to Thomas, Jr. discloses a rotational exercise device, but it is intended for the hands and arms and not the feet.

All of the above exercise machines used a central pivot point for the foot or ski. Applicant's invention is not concerned with training the body for skiing. Applicant's exercise device utilizes a different pivot point placement which will be described below. By utilizing an off center pivot point for the foot platforms, the muscles of the upper leg and buttocks region can be strengthened by repeated usage of the present invention. It is well known that strengthened and well conditioned sphincter muscles inprove sexual performance considerably. The present invention can offer help to men suffering from impotence or heighten sexual ability in men who do not suffer from such a disability.

SUMMARY OF THE INVENTION

Accordingly, it is an object of the present invention to provide an exercise device for the feet and the leg muscles which has a pivot point which is off center in relation to the user's foot.

It is an object of the present invention to provide an exercise device for the feet and the leg muscles which raises the heels of the user when the feet are rotated.

It is another object of the present invention to provide an exercise device for the feet and the leg muscles which allows a user to bring his heels together under tension.

It is a further object of the present invention to provide an exercise device for the feet and the leg muscles which allows a user to increase the tension which acts against the user's motions.

It is one object of the present invention to provide an exercise device for the feet and the leg muscles which strengthens the gluteg, gracilis and adductor muscles.

It is an object of the present invention to provide an exercise device which can improve sexual performance through repeated usage.

These and other objects of the present invention will become readily apparent upon further review of the following specification and drawings.

BRIEF DESCRIPTION OF THE DRAWINGS

FIG. 1 is a perspective view of the present invention showing the foot platforms.

FIG. 2 is a side view of the present invention.

Similar reference characters denote corresponding features consistently throughout the attached drawings.

A DETAILED DESCRIPTION OF THE PREFERRED EMBODIMENT

Figure 3:
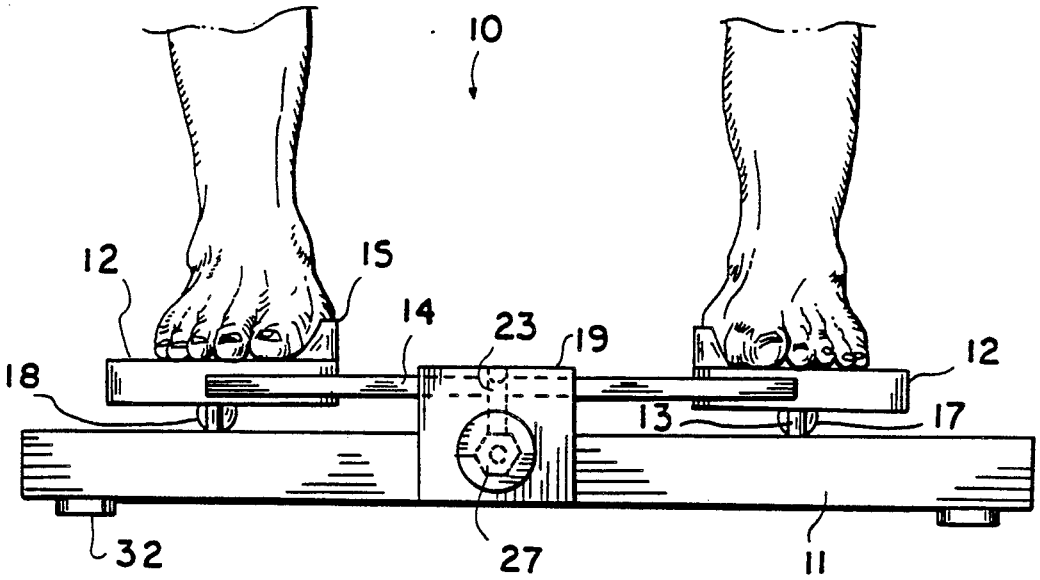
FIG. 3 is a front view of the present invention.

The present invention of an exercise device 10 is shown from the top in FIG. 1. It includes a base platform 11 upon which are mounted two foot platforms 12. The base can sit upon soft rubber of plastic feet 32. Each foot platform 12 is pivoted to the base platform 11 by means of a pivot shaft 13. The positioning of the pivot shaft 13 is special in that it is toward the front portion of the foot platform 12. This allows the user to achieve a high leverage against the tensioning member 14.

The foot platofrms 12 comprise molded and contoured units for each foot. Bracing 15 would prevent the foot from slipping off the platform when pressure was applied. More advanced forms of the invention can have a shoe or slipper for holding the foot in place on the foot platform 12. Massage fingers 30 placed on the platforms 12 would allow the user to exercise his or her feet and legs while massaging the soles of the feet. These protrusions 30 also serve as anti-slip means, which is especially important in the morning when people have just exited the shower and are wet when using the device as part of their daily morning exercise regimen.

Figure 4:
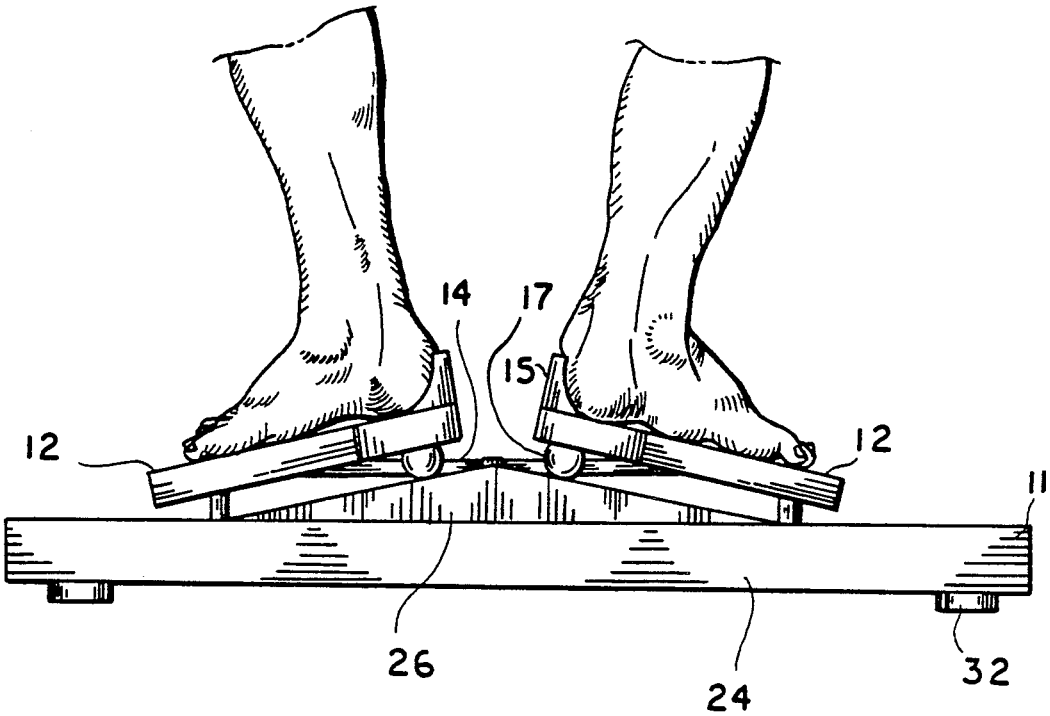
FIG. 4 is a rear view of the present invention with the feet and heels rotated inwardly and showing the heel risers.

The actual work is done by stretching the elastic tensioning member 14 placed between the front toe portions 16 of the foot platforms 12. this tensioning member 14 can be a spring or an elastic bungee cord. When the user rotates the foot platforms 12 inwardly, the cord 14 is stretched and therfore provides resistance. The best method of using the exercise device 10 is to rotate the foot platforms 12 inwardly, as shown in FIG. 4, and hold this position for a few seconds at a time. This rotation and holding patern should be repeated for up to 5 to 10 minutes a day in order to properly strengthen the muscles of the upper leg region and the buttocks region. Rotation and rlease of the foot platforms 12 should be done slowly as with any strenuous exercise so as not to damge and strain the muscles with sudden forces. One effect of this exercise will be increased sexual performance due to the strengthening of the sphincter muscles.

Placed beneath each foot platform 12 are universal castors 17 which the foot platforms 12 ride upon. The castors 17 should have a hard metal bearing 18 which should ride smoothly on the surface of the base platform 11. The base platform 17 itself should be smooth so as not to present any unwanted bumps and resistances. A hard steel base platform 11 would serve as the best sort. Along the back end 24 of the base platform 11 is a raised portion 26, shown if FIG. 4. This slight rise 26 allows the heels of the user to be lifted when the heels are rotated inward with the foot platforms 12. This riser 26 can be produced on the base platform by molding or forging the base platform 11. The riser 26 produces flexing of the ankles in addition to exercising the leg muscles.

In order for the foot platforms 12 to be able to run up the riser 26, they must be somewhat flexible. By constructing the foot platforms 12 out of a flexible plastic material, the foot platforms 12 will be able to bend sufficiently to adapt to the riser 26. A molded polymeric foot platform 12 would allow the massage fingers 30 to be molded along with the side braces 15 as one unit.

At the front end 25 of the base platform 11 is a tension adjustment mechanism 18 for raising or lowering the resistance to rotating the front platforms 12. Mounted by screws or other conventional means (not shown) to the front end 25 of the base platform 11 is a bracket 19 through which is disposed a screw shaft 20 having threads upon it. The bracket has an aperture 21 through which the shaft 20 is disposed. The aperture having the mating threads to engagethe shaft 20. The shaft 20 is placed beneath the surface of the base platform 11. A nut 27 rides on the screw shaft 20. This nut has an extended protrusion or finger 23 which points upward. The finger 23 rides in a slot 28 on the base platform 11. The knob 22 at the other end of the shaft 20 allows for the shaft 20 to be rotated and finger 23 to pull against the tensioning member 14 in order to increase the resistance of rotating the foot platforms 12. By being able to vary the tension in the tensioning member 14, when the foot platforms are fully rotated, various degrees of exercise can be reached. Not all individuals can use the same tension due to different strengths.

It is to be understood that the present invention is not limited to the sole embodiment described above, but encompasses any and all embodiments within the scope of the following claims.

I claim:

1. An exercising device for strengthening the muscles of the upper leg and spincter region including:

a base platform comprisign a smooth planar surface and having a front and a rear edge;

a pair of foot platforms having forward and rear portions for placement of each foot of a user mounted atop said base platform and at substantially opposite ends of said base platform;

pivoting means attached between the planar surface of said base platform and an underside of said foot platforms pivotally mounting said foot platforms to said base platform, said pivoting means being attached to a forward portion of said foot platforms;

support means disposed under said foot platforms and stop said planar surface allowing said foot platforms to move smoothly over said planar surface and said user to stand in a normal fashion;

elastic tensioning means disposed between and connecting said forward portins of said foot platforms; and whereby the user of said device places each foot on a foot platform and turns his heels inward against the resistance of said elastic tensioning member to exercise the muscles of the upper leg and the spincter region.

2. The exercise device according to claim 1, including:

tension adjusting means for increasing the tension of said tensioning member.

3. The exercise device according to claim 1, wherein:

said support means are universal castors mounted beneath said foot platforms.

4. The exercise device according to claim 2, wherein said tension adjusting means comprises a bracket mounted to said base platform on said front edge, said bracket having an aperture disposed therethrough, a shaft disposed through said bracket aperture, said shaft and aperture having interengaging threading, and a nut which rides on said shaft, said nut having an extended protrusion normal to said shaft, said protrusion disposed adjacent said tensioning member on a side opposite said bracket, whereby rotation of said shaft causes said finger portion to pull against said tensioning member and increase tension when said foot platforms are rotated.

5. The exercise device according to claim 1, including:

riser means disposed atop said planar surface adjacent said foot platform rear portions, said riser means having a gradual slope upward from said planar surface, said foot platforms rear portions engaging said riser means upon rotation thereby lifting the heel of the user.

6. The exercise device according to claim 5, wherein:

said foot platforms are constructed from a flexible material lending said foot platforms a substantial flexibility.

7. The exercise device according to claim 1, including:

massage fingers comprising protrusions disposed atop said foot platforms.

8. The exercise device according to claim 1, wherein:

said tensioning member is an elastic cord.

* * * * *